US008038735B2

(12) United States Patent
Yeh et al.

(10) Patent No.: US 8,038,735 B2
(45) Date of Patent: Oct. 18, 2011

(54) DEEP DYEING PROCESS OF POLYAMIDE AND POLYOLEFIN

(75) Inventors: Jen-Taut Yeh, Taipei (TW); Kan-Nan Chen, Taipei (TW); Chi-Hui Tsou, Banqiao (TW); Jing-Wen Tang, Hsinchu (TW)

(73) Assignees: Jen-Taut Yeh, Taipei (TW); Hong Jen Textile Co. Ltd, Taipei (TW)

( * ) Notice: Subject to any disclaimer, the term of this patent is extended or adjusted under 35 U.S.C. 154(b) by 0 days.

(21) Appl. No.: 12/550,558

(22) Filed: Aug. 31, 2009

(65) Prior Publication Data

US 2011/0047719 A1 Mar. 3, 2011

(51) Int. Cl.
*D06P 3/06* (2006.01)
*D06P 3/10* (2006.01)

(52) U.S. Cl. ..... 8/516; 8/489; 8/497; 8/543; 8/636; 8/924

(58) Field of Classification Search ..... 8/494, 928, 8/924, 489, 497, 516, 543, 636
See application file for complete search history.

(56) References Cited

U.S. PATENT DOCUMENTS 3,107,228 A * 10/1963 Vacanti et al. ..... 525/113
3,928,504 A * 12/1975 Koelewijn ..... 525/322

OTHER PUBLICATIONS

Derwent abstract JP77000974, 1977.*
Derwent abstract JP48103824, 1974.*
Derwent abstract JP74014428, 1975.*

* cited by examiner

*Primary Examiner* — Amina Khan
(74) *Attorney, Agent, or Firm* — Chun-Ming Shih

(57) ABSTRACT

In a deep dyeing process of a polyamide (PA) including Nylon 4, Nylon 6, Nylon 46, Nylon 66, Nylon 7, Nylon 8, Nylon 9, Nylon 610, Nylon 1010, Nylon 11, Nylon 12, Nylon 13, Nylon 612, Nylon 9T, Nylon 13, MC Nylon, Nylon MXD6, and all polyamide derivatives, and a polyolefin (PO) including ethylene copolymer, propylene copolymer and their derivatives, a compatibilizer precursor is used for modifying the polyamide and polyolefin of an amino, hydroxyl or epoxy group containing chemical, and then a reactive dye and/or an acid dye is used for dyeing the polyamide and polyolefin, so that the dyed polyamide and polyolefin have excellent dye fastness, light fastness, rubbing fastness, washing fastness and low-temperature dyeability to overcome the shortcomings of conventional nylon fibers including a poor dyeing effect, a non-level dyeing quality, a high dyeing temperature (100° C. to 120° C.) and a high cost.

6 Claims, 4 Drawing Sheets

DEEP DYEING PROCESS OF POLYAMIDE AND POLYOLEFIN

BACKGROUND OF THE INVENTION

1. Field of the Invention

The present invention relates to a deep dyeing process of a polyamide (PA or nylon including Nylon 4, Nylon 6, Nylon 46, Nylon 66, Nylon 7, Nylon 8, Nylon 9, Nylon 610, Nylon 1010, Nylon 11, Nylon 12, Nylon 13, Nylon 612, Nylon 9T, Nylon 13, MC Nylon, Nylon MXD6 and all polyamide derivatives) and a polyolefin (including ethylene copolymer, propylene copolymer, and related derivatives), and the deep dyeing process uses a compatibilizer precursor and an amino, hydroxyl or epoxy group containing chemical to modify the polyamide and polyolefin, and the modified polyamide and polyolefin has a low-temperature dyeability, and finally uses a reactive dye and/or an acid dye to perform the dyeing process, such that the dyed polyamide and polyolefin fibers have excellent dye fastness, light fastness, rubbing fastness and washing fastness.

2. Description of Related Art

In general, polyamide (PA) or nylon is a linear condensation polymer composed of repeated primary bonds of amide groups (—CONH—), and featuring high crystallization, chemical resistance, oil resistance, solvent resistance, and abrasion resistance, a small coefficient of friction, a high level of thermal degradation, a broad manufacturing scope, and a self-lubrication. In addition, the mechanical properties of nylon has the advantages of high tensile strength, high impact resistance and excellent elasticity, tenacity and extensibility, and thus nylon can be used extensively as a composite material for the textile industry, an industrial fiber or an agent for enhancing fibers.

The structure of nylon is characterized in that an end of its molecular chain includes a functional group such as a carboxyl group (—COOH) and an amino group (—$NH_2$) having a good dyeability, and a large number of carbon-hydrogen bonds (—$CH_2$) and amide groups (—NHCO—) at the middle of the molecular chain, and thus various different types of dyes such as ionic dyes, acid mordant dyes, metal complex acid dyes, direct dyes, dispersive dyes, azo dyes, vat dyes, and acid dyes can be used for dyeing nylon fibers, and the dyeability of fibers depends on the dispersion of the dye and the affinity between the fibers and dye as well as their connection. In the aforementioned dyes, only the acid dye contains hydrophilic groups of sodium sulfonate radicals (—$SO_3Na$) that can be combined with the amino groups (—NH+) of the nylon fibers by the ionic bonds or electrostatic forces to provide better dyeability and brighter color, and the rest of the aforementioned dyes are combined with the nylon fibers by hydrogen bonds or Van der Waals forces to provide a lighter color. As to the uniform dyeability, the acid dye is the first choice for dyeing nylon fibers, and thus the acid dye is a popular application used most in related industries.

With reference to FIG. 2 for a conventional polyamide fiber dyeing process, the polyamide fibers are modified in a modification process and dyed with the acid dye, wherein the conventional modification process of the polyamide adds a chain regulator of different types and additive quantities to increase the content of amino groups (—$NH_2$) at the ends of a molecular chain of the nylon, while introducing a functional group with a special structure or adds a dye leveling agent or another co-agent in the dyeing process and performing a supersonic treatment, and finally a color fixation is performed after the dyeing process takes place in an oxidation-reduction system or water is used as a ring opening agent to perform an open ring polymerization of the amide group (—NHCO—) to reduce the polymerization induction period and improve the reaction speed, such that when a new equilibrium is reached, the number of polymer molecules is increased, and the content of amino groups (—$NH_2$) will be increased accordingly, and the temperature before/after the hydrolysis and polymerization of the amide group (—NHCO—) will be increased appropriately, such that the content of amino groups (—$NH_2$) at the ends of the molecular chain can be increased to achieve the modification effect.

Since the content of amino groups (—$NH_2$) at the ends of the molecular chains of the nylon is very low (about 5~10% of wool only), therefore the aforementioned modification process still cannot achieve the effect of improving the content of amino groups (—$NH_2$) significantly. In other words, the dyeing effect of the nylon is relatively poor. Obviously, the conventional nylon fiber dyeing process has the following drawbacks:

1. The conventional process can achieve a mid-depth dyeing effect only. Since the acid dye and the polyamide are combined by the ionic bond or the electrostatic force, the bonding is relatively weak, and only a mid-depth dyeing effect can be obtained.

2. The conventional process generally results in poor dye fastness, light fastness, and washing fastness. The color of a dyed nylon processed by the conventional polyamide fiber dyeing process may be faded or stained easily by rinsing or exposures to sunlight or gas. The conventional dyed nylon has poor dye fastness, light fastness, and washing fastness.

3. The conventional process gives a non-level dyeing quality and incurs a high cost. In the conventional deep dyeing process of polyamide fibers, color difference, color deviations and stained spots may occur easily due to the dyeing condition and the selection of co-agents. In the meantime, the conventional deep dyeing process of the nylon fibers involves complicated dyeing process and color fixation and incurs a high cost.

4. The conventional process requires a high dyeing temperature. The temperature for the conventional polyamide fiber dyeing process must be over 100~120° C., and thus the process causes high costs and power consumptions.

Obviously, the conventional polyamide fiber dyeing process requires further improvements.

In addition, polyolefin (such as polyethylene and polypropylene) has the features of a light weight, a plentiful resource, a simple manufacturing process, a small specific gravity, and a low water absorption and the functions of chemical resistance, electrostatic resistance, and pollution resistance, and thus polyolefin is used extensively in many areas due to its functions and low production cost.

The non-polar structure of polyolefin is generally considered as a major hidden problem that polyolefin cannot be dyed, since the polyolefin fibers have a very low hydrophilic property, and thus the affinity between a dye and a chemical co-agent is poor, and conventional dyeing and printing methods are unable to achieve an expected dyeing effect. At present, an organic or inorganic dye is generally used for dyeing the polyolefin fibers and such method of coloring the polyolefin fibers incurs a low cost and achieves a better fastness. However, this method is suitable for a mass production of products in a single series of colors only, and unable to meet the requirements of the consumer market, and its drawbacks include an incapability of printing patterns and a high inventory, etc. As a result, polyolefin is primarily used for manufacturing a large quantity of carpets or a small quantity of clothes that require less color only. Therefore, it is an important subject for manufacturers to apply a general dyeing technique to the polyolefin fibers, and for scholars to do researches to improve the dyeing effect of polyolefin fibers, and some scientists have used a chlorination of sodium hypochlorite and a photo-chemical bromination to modify the polypropylene fibers in order to perform the dyeing with a cationic dye, and the modified polypropylene fibers and dye produce covalent forces to achieve the effects of enhancing the bleaching fastness, washing fastness, seawater fastness and moisture regain, while reducing the strength and requiring a post-treatment to improve the light fastness. Some manufacturers have also attempted using a series of polyurethane compounds and a radiating beam to polymerize the polypropylene compounds to produce a copolymer suitable for the dyeing process with a cation dye, an acid dye or a dispersive dye, and some manufacturers have added a polar additive to polypropylene to produce fibers that are dyed with an acid dye, and some manufacturers even have attempted using hydrogenated oligocyclopentadiene or wool to weave polypropylene fibers. With the aforementioned methods, manufacturers attempted to increase the dyeability of polypropylene, but also lowered the photo-sensitivity and mechanical property of the polypropylene at the same time. Mostly important, the high cost of the modification makes polypropylene unfavorable to commercial applications. The dispersive dye and the hydrophobic fiber having a good compatibility among molecules in supercritical carbon dioxide are suitable for a dyeing process without requiring any co-agents. With the aforementioned perfect PET dyeing technology, the dispersion of the dispersive dye in the fibers and the solubility of the dispersive dye of a supercritical condition are studied. The dispersion and solubility of dyes can be determined by the properties of the dyes. In addition, the dispersive dye in supercritical $CO_2$ can be used for dyeing polyolefin fibers, and the dye can be a dispersive azo dye having a benzene ring structure, and thus its color is darker than a general dispersive dye. In addition to the high cost and the incapability for commercialization, the use of azo dyes is not recommended due to the issue of environmental protection and even prohibited in some developed countries (such as European Union). In summation of the description above, the conventional polyolefin fiber dyeing process still has the following shortcomings:

1. The conventional dyeing process only provides a mid-depth dyeing effect. Since the conventional modified polyolefin is dyed with a dispersive dye and the attraction force between physical bonds (such as hydrogen bonds or Van der Waal forces) has a weaker bonding, only a mid-depth dyeing effect can be obtained.

2. The conventional dyeing process has poor dye fastness, light fastness, and washing fastness. The polyolefin fibers dyed by the conventional dyeing process may be faded or stained easily under sunlight or exposure to special gases due to the poor dye fastness, light fastness, washing fastness and rubbing fastness.

3. The conventional dyeing process has a non-level dyeing quality and incurs a high cost. A color difference, a color deviation and a stained spot may occur easily due to the dyeing conditions and the selection of co-agents. In the meantime, the conventional deep dyeing process of the nylon fibers involves complicated dyeing process and color fixation and incurs a high cost.

4. The conventional dyeing process requires a high dyeing temperature. The temperature for the conventional polyamide fiber dyeing process must be over 90~120° C., and thus it causes high cost and power consumption.

5. The conventional dyeing process is incompliant with the requirements of environmental protection. Azo dyes and metal-containing dyes are not recommended due to the issue of environmental protection, and they are even prohibited in some developed countries (such as European Union).

Therefore, the conventional polyolefin fiber dyeing process still has the foregoing shortcomings and requires immediate attention and feasible solutions.

SUMMARY OF THE INVENTION

Therefore, it is a primary objective of the present invention to provide a deep dyeing process of polyamide and polyolefin, and the deep dyeing process uses a compatibilizer precursor and an amino, hydroxyl or epoxy group containing chemical to modify a polyamide (PA or nylon) including Nylon 4, Nylon 6, Nylon 46, Nylon 66, Nylon 7, Nylon 8, Nylon 9, Nylon 610, Nylon 1010, Nylon 11, Nylon 12, Nylon 13, Nylon 612, Nylon 9T, Nylon 13, MC Nylon, Nylon MXD6 and all polyamide derivatives) and a polyolefin (including ethylene copolymer, propylene copolymer, and related derivatives) and then uses a reactive dye and/or an acid dye for a dyeing process, so as to overcome the shortcomings of the conventional nylon fiber dyeing process that is capable of providing a mid-depth dyeing effect only and resulting in poor dye fastness, light fastness, rubbing fastness, and washing fastness, and a non-level dyeing quality, a high dyeing temperature, and a high cost.

BRIEF DESCRIPTION OF THE DRAWINGS

The invention, as well as its many advantages, may be further understood by the following detailed description and drawings in which.

DETAILED DESCRIPTION OF THE INVENTION

To make it easier for our examiner to understand the technical characteristics and operating procedure of the present invention, we use preferred embodiments together with the attached drawings for the detailed description of the invention as follows.

In a deep dyeing process of polyamide and polyolefin in accordance with the present invention, a compatibilizer precursor (such as a carboxyl polymer, an anhydride polymer, a hydroxyl polymer, an epoxy polymer and a cyanate-based compound) and an amino group (wherein the amino group containing chemical is one selected from the collection of ethylene diamine, diethylenetriamine, triethylenetetramine, tetra-ethylene pentamine, pentaethylenehexamine, hexaethyleneheptamine, polyethylene polyamine and their related derivatives), and a hydroxyl group or epoxy group containing chemical are used for modifying the polyamide (PA or nylon) and polyolefin (PO), and then a reactive dye and/or an acid dye are used for the dyeing process to provide the dyed polyamide and polyolefin with excellent dye fastness, light fastness, rubbing fastness, and washing fastness, so as to overcome the shortcomings of the conventional polyamide fiber dyeing process.

Figure 1:
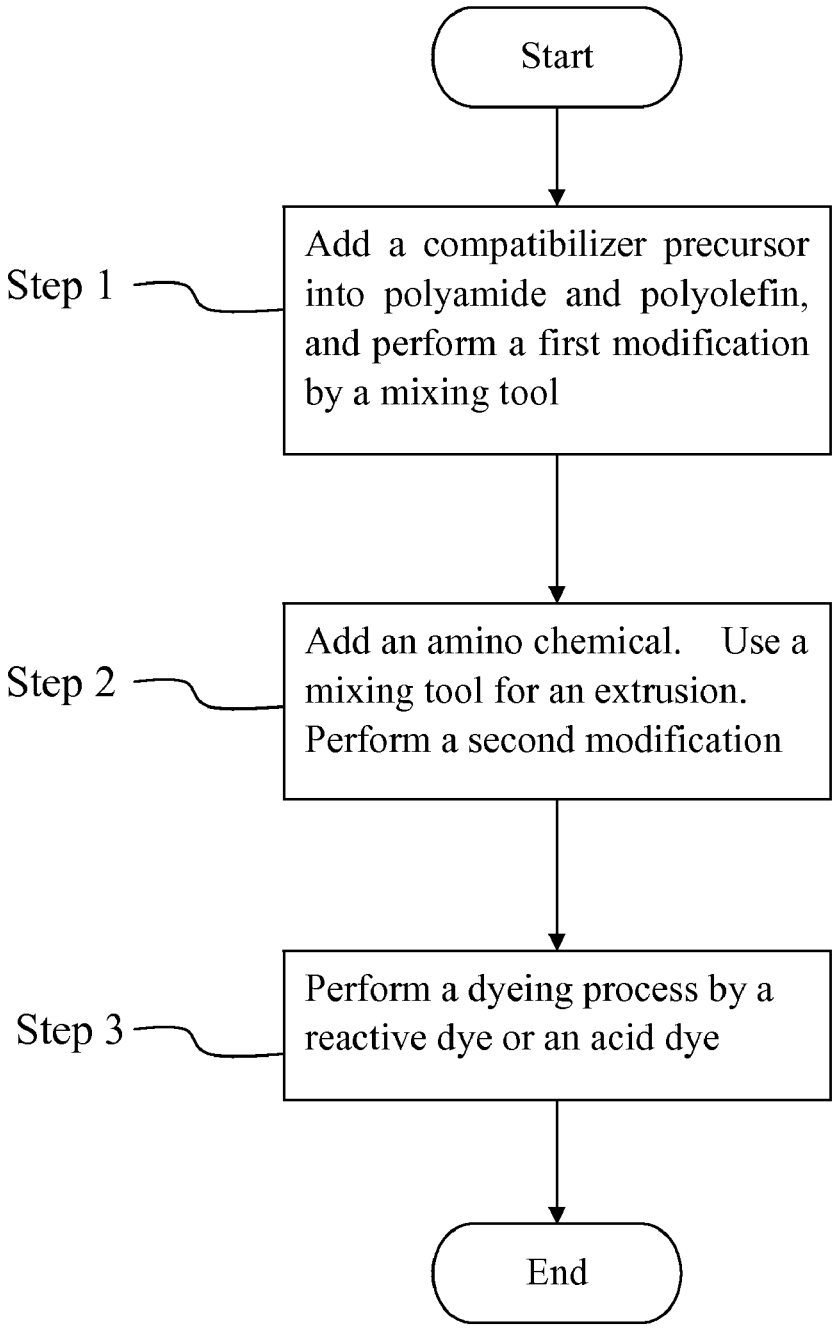
FIG. 1 is a flow chart of the present invention.
Figure 2:
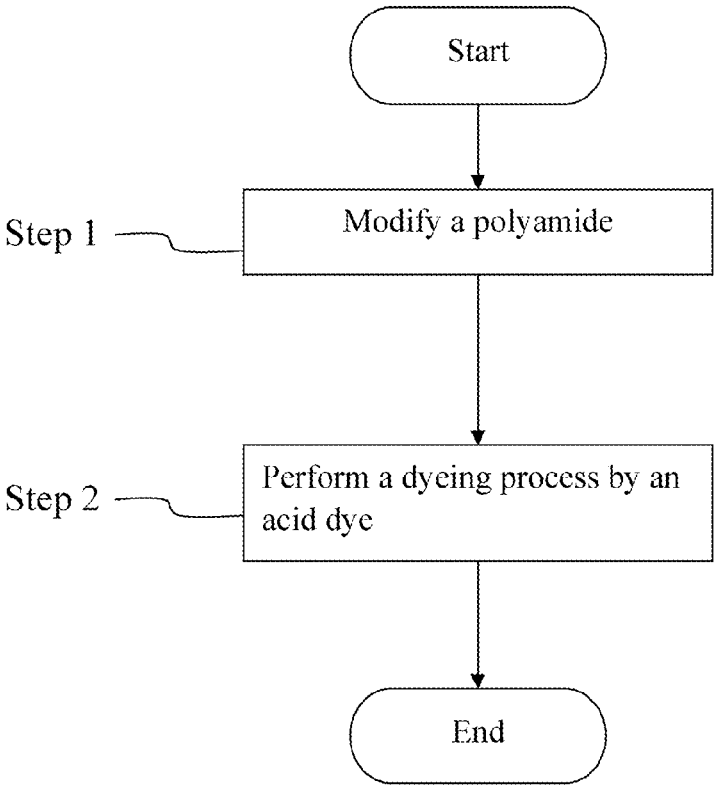
FIG. 2 is a flow chart of a conventional dyeing process of polyamide fibers.

With reference to FIG. 1 for a flow chart of the aforementioned deep dyeing process of the present invention, the deep dyeing process comprises the following steps:

Step 1 performs a first modification of polyamide and polyolefin. A compatibilizer precursor (CP, which is alkylcarboxy-substitute polyolefin used in the present invention) is added into the polyamide and polyolefin, and a mixing tool (such as a double screw extruder or mixer) is used for performing the first modification of polyamide and polyolefin at a predetermined temperature (which is 150~250° C., and preferably 240° C.) by a predetermined round-per-minute extrusion and mixing process (at 1 Hz to 200 Hz) to prepare a modified polyamide (MPA) and a modified polyolefin (MPO).

Step 2 performs a second modification of polyamide and polyolefin. An amino group containing chemical (which is triethylenetetramine (TETA) used in the present invention) is added into the modified polyamide and the modified polyolefin, and then the mixing tool is used for performing a second modification of the polyamide and polyolefin at the predetermined temperature by the predetermined round-per-minute extrusion and mixing process. The modified polyamide and modified polyolefin are modified again, and their chemical formulae are given below:

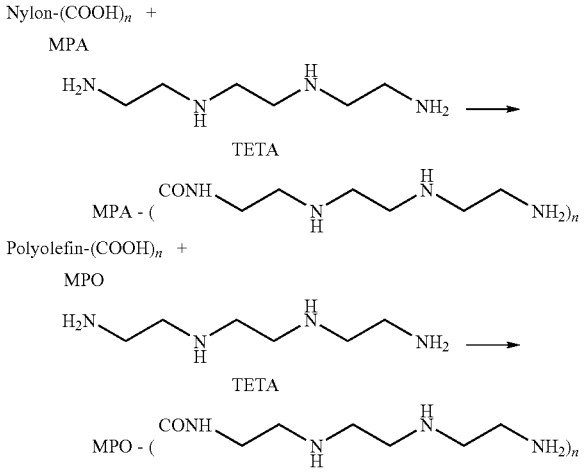

Step 3 uses a reactive dye for the dyeing process. After a melt spinning is performed for the second modified polyamide (MPA) and polyolefin (MPO) at a predetermined temperature (which is 235° C. adopted in the present invention), a reactive dye (which is a Lanasol dye produced by Ciba Company and used in the present invention) is used for the dyeing process to complete the deep dyeing of the polyamide and polyolefin.

In the aforementioned deep dyeing process, the compatibilizer precursor (CP) and the amino, hydroxyl or epoxy group containing chemical (which is triethylenetetramine (TETA) used in the present invention) can be added into the polyamide and polyolefin at the same time, and the mixing tool is used for the modification at the predetermined temperature by a predetermined round-per-minute extrusion and mixing process (at 1 Hz to 200 Hz).

A melt spinning is performed for the modified polyamide (MPA) and modified polyolefin (MPO), and a reactive dye is used for the dyeing process to complete the deep dyeing of the polyamide and polyolefin.

The following test results show that the polyamide and polyolefin dyed by the deep dyeing process of the present invention have an excellent dyeing depth.

Table 1 shows the test results of a pollution fastness, a color fading fastness, and a washing fastness of modified polyamides (MPA) dyed by the conventional Nylon (PA) dyeing process and the dyeing process of the present invention taken at 60° C., 80° C. and with a reactive dye respectively:

TABLE 1

Six Types (W, A, T, N, C, Ac) of Pollution Fastnesses of Test Fabrics

| Sample | | Polyamide (PA) | | | | Modified Polyamide (MPA) | | | |
|---|---|---|---|---|---|---|---|---|---|
| | | Red | Blue | Black | Yellow | Red | Blue | Black | Yellow |
| Pollution Fastness | W | 4 | 4 | 4 | 4 | 5 | 5 | 5 | 5 |
| | A | 5 | 5 | 5 | 5 | 5 | 5 | 5 | 5 |
| | T | 5 | 5 | 5 | 5 | 5 | 5 | 5 | 5 |
| | N | 4 | 4 | 4 | 4 | 5 | 5 | 5 | 5 |
| | C | 4 | 4 | 4 | 4 | 5 | 5 | 5 | 5 |
| | Ac | 5 | 5 | 5 | 5 | 5 | 5 | 5 | 5 |
| Color Fading Fastness | | Levels 4~5 | Levels 4~5 | Levels 4~5 | Levels 4~5 | Level 5 | Level 5 | Level 5 | Level 5 |

In Table 1, the test results show that the pollution fastnesses and color fading fastness of the conventional polyamide (PA) fall in Levels 4~5. On the other hand, the pollution fastnesses and color fading fastness of the modified polyamide (MPA) dyed by the dyeing process of the present invention fall at Level 5 (which is the highest level), and thus it shows that the deep dyeing process of the present invention can enhance the washing fastness of the polyamide fibers substantially.

Table 2 shows the test results of a light (xenon arc light) fastness of modified polyamides (MPA) dyed by the conventional polyamide (PA) dyeing process and the dyeing process of the present invention taken at 80° C. and with a reactive dye respectively:

TABLE 2

| Tetra-ethylene Pentamine (TEPA) Content (%) of Modified Polyamide (MPA) | | Polyamide (PA) | Modified Polyamide (MPA) |
|---|---|---|---|
| Level | Blue | 5-6 | 8 |
| | Red | 6 | 8 |
| | Black | 5-6 | 8 |
| | Yellow | 6 | 8 |

In Table 2, the test results show that the light (xenon arc light) fastness of the conventional polyamide (PA) fall in Levels 4~5. On the other hand, the light (xenon arc light) fastness of the modified polyamide (MPA) dyed by the dyeing process of the present invention fall at Level 8 (which is the highest level), and thus it shows that the deep dyeing process of the present invention can enhance the light fastness of the polyamide fibers substantially.

Table 3 shows the test results of a rubbing fastness of modified polyamides (MPA) dyed by the conventional polyamide (PA) dyeing process and the dyeing process of the present invention taken at 60° C. and 80° C. and with a reactive dye respectively:

TABLE 3

| Sample | | Polyamide (PA) | | | | Modified Polyamide (MPA) | | | |
|---|---|---|---|---|---|---|---|---|---|
| | | Red | Blue | Black | Yellow | Red | Blue | Black | Yellow |
| Dry Rubbing Level | Pollution Fastness | 5 | 5 | 5 | 5 | 5 | 5 | 5 | 5 |
| | Color Fading Fastness | 5 | 5 | 5 | 5 | 5 | 5 | 5 | 5 |
| Wet Rubbing Level | Pollution Fastness | 4 | 4-5 | 4-5 | 4 | 5 | 5 | 5 | 5 |
| | Color Fading Fastness | Level 4 | Levels 4~5 | Levels 4~5 | Level 4 | Level 5 | Level 5 | Level 5 | Level 5 |

In Table 3, the test results show that the wet rubbing fastness of the conventional polyamide (PA) fall at level 4 or in Levels 4~5. On the other hand, the rubbing fastness of the modified polyamide (MPA) dyed by the dyeing process of the present invention fall at Level 5 (which is the highest level), and thus it shows that the deep dyeing process of the present invention can enhance the rubbing fastness of the polyamide fibers substantially.

Figure 3:
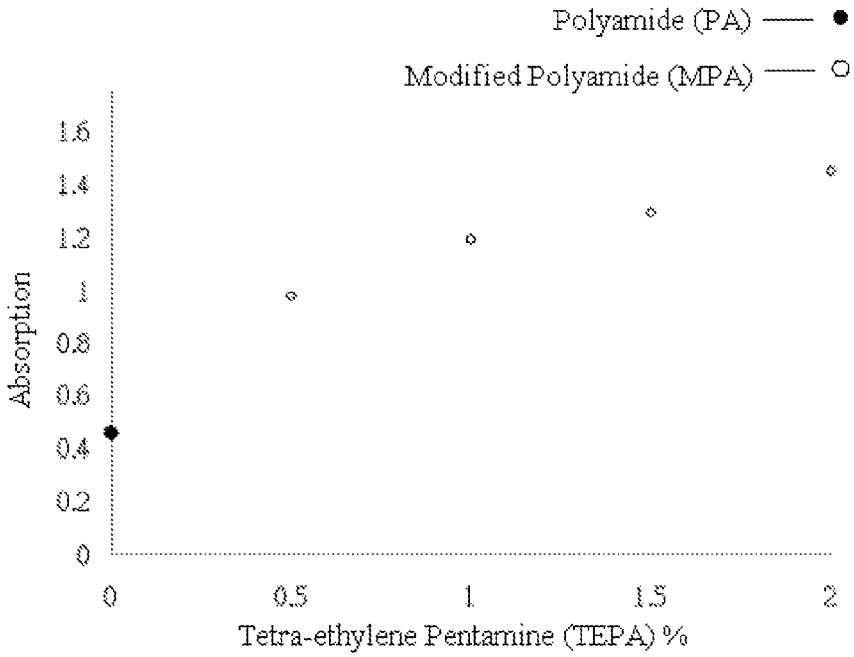
FIG. 3 show test results of light absorptions of polyamides dyed at 100° C. and with a reactive dye by a conventional polyamide fiber dyeing process and by a dyeing process in accordance with the present invention respectively and measured by an ultraviolet spectroscope.

With reference to FIG. 3 for test results of light absorptions of polyamides dyed at 100° C. and with a reactive dye by a conventional polyamide fiber dyeing process and by a dyeing process in accordance with the present invention respectively and measured by an ultraviolet spectroscope, the test results show that the light absorption of the polyamide (PA) dyed by the conventional dyeing process is only 0.47, and the light absorptions of the modified polyamides dyed by the dyeing process of the present invention with a tetra-ethylene pentamine (TEPA) content of 0.5%, 1%, 1.5% and 2% fall within a range of 0.9~1.5, and thus it shows that the deep dyeing process of the present invention improves the dyeing quality substantially.

Figure 4:
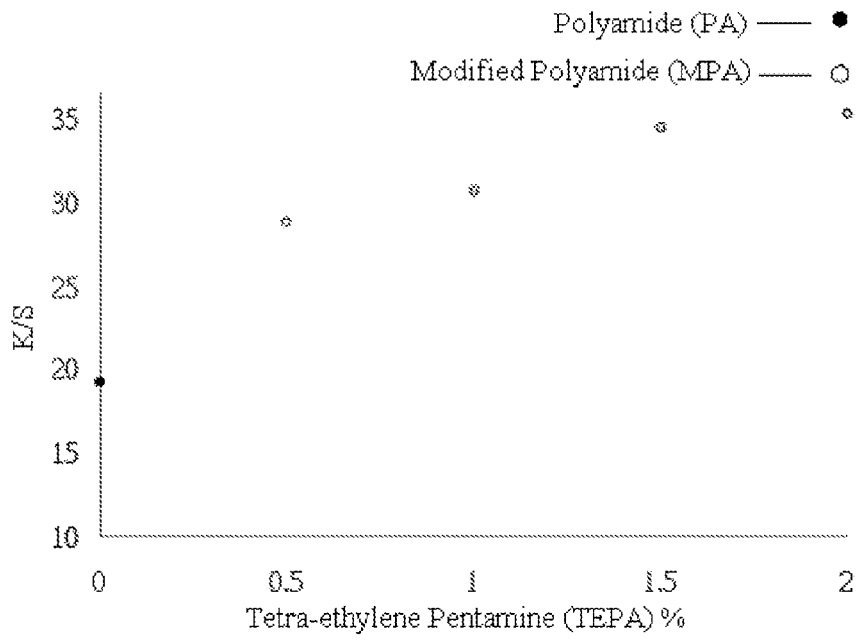
FIG. 4 shows test results of color strengths (K/S) of polyamides dyed at 100° C. and with a reactive dye by a conventional polyamide fiber dyeing process and by a dyeing process in accordance with the present invention respectively and measured by a spectral color meter.

With reference to FIG. 4 for the test results of color strengths (K/S) of polyamides dyed at 100° C. and with a reactive dye by a conventional polyamide fiber dyeing process and by a dyeing process in accordance with the present invention respectively and measured by a spectral color meter, the test results show that the K/S value of the polyamide (PA) dyed by the conventional dyeing process is only 19, and the K/S values of the modified polyamide (MPA) dyed by the dyeing process of the present invention with a tetra-ethylene pentamine (TEPA) content of 0.5%, 1%, 1.5% and 2% fall within a range of 28.7~35.2, and thus it shows that the deep dyeing process of the present invention improves the dyeing depth of the nylon fibers substantially.

In summation of the description above, the main characteristics and differences of the present invention from the conventional nylon fiber dyeing process are listed below:

1. The present invention is novel and improves over the prior art. Since the conventional polyamide fiber dyeing process uses an acid dye for dying nylon fibers, and a bonding of an ionic bond and an electrostatic force is formed between the acid dye and the polyamide fiber, therefore the affinity is weaker. On the other hand, the present invention uses a reactive dye and/or an acid dye for the dyeing process, and thus provides a better and brighter color effect and a better recurrence, and a very strong bonding of covalent bonds is formed between the reactive dye and/or acid dye and the polyamide and polyolefin, so that the dyed polyamide and polyolefin have excellent dye fastness, light fastness, and washing fastness to overcome the weaker bonding affinity caused by the conventional nylon fiber dyeing process that can provide a mid-depth dyeing effect only, and poor dye fastness, light fastness, and washing fastness. Thus, the present invention is novel and improves over the prior art.

2. The present invention is practically useful. The conventional polyamide fiber dyeing process requires adding a dye leveling agent or another co-agent in the dyeing process to maintain the dyeing quality. On the other hand, the present invention uses two times of modification to increase the content of amino groups (—$NH_2$) at an end of a molecular chain of the polyamide for bonding the reactive dye and/or the acid dye to achieve a level dyeing effect. In the meantime, the invention can lower the cost significantly to overcome the shortcomings including the non-level dyeing quality and the high cost of the conventional polyamide fiber dyeing process. Thus, the present invention is practically useful.

3. The present invention has a low-temperature dyeability for achieving the purpose of energy saving and carbon reduction. The conventional nylon fiber dyeing process requires a high-temperature dyeing at a temperature over 100~120° C., and incurs a high power consumption and much effort. On the other hand, the present invention can perform the dyeing process at 60° C., and thus the invention complies with the requirements for cost-effectiveness, low cost, and energy saving and carbon reduction policy promoted by the government. The invention can overcome the shortcoming of the conventional nylon dyeing process that requires a high temperature for the dyeing, and thus achieves the energy saving and carbon reduction effects.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A deep dyeing process comprising the steps of:

providing polyamide;

adding a compatibilizer precursor selected from a cyanate-based polymer in the polyamide, and using a mixing tool to perform a first modification at a predetermined temperature by a predetermined round-per-minute extrusion and mixing process;

adding an amino or hydroxyl group containing chemical in the first modified polyamide, and then using the mixing tool to perform a second modification at the predetermined temperature by the predetermined round-per-minute extrusion and mixing process; and melt spinning the second modified polyamide, and then using a reactive dye and/or an acid dye for performing the dyeing process to complete the deep dyed polyamide.

2. The deep dyeing process as recited in claim 1, wherein the amino group containing chemical is one selected from ethylene diamine, diethylenetriamine, triethylenetetramine, tetra-ethylene pentamine, pentaethylenehexamine and hexaethyleneheptamine and their related derivatives.

3. The deep dyeing process as recited in claim 1, wherein the predetermined temperature is 150~250° C.

4. A deep dyeing process comprising the steps of:

providing polyamide;

adding a compatibilizer precursor selected from a cyanate-based polymer and adding an amino or hydroxyl group containing chemical in the polyamide, and using a mixing tool to perform a modification at a predetermined temperature by a predetermined round-per-minute extrusion and mixing process; and melt spinning the modified polyamide, and using a reactive dye and/or an acid dye for performing a dyeing process to complete deep dyeing the polyamide.

5. The deep dyeing process as recited in claim 4, wherein the amino group containing chemical is one selected from the collection of ethylene diamine, diethylenetriamine, triethylenetetramine, tetra-ethylene pentamine, pentaethylenehexamine and hexaethyleneheptamine and their related derivatives.

6. The deep dyeing process as recited in claim 4, wherein the predetermined temperature is 150~250° C.

* * * * *